US012104448B1

(12) United States Patent
DeGear et al.

(10) Patent No.: US 12,104,448 B1
(45) Date of Patent: Oct. 1, 2024

(54) GREASE-RETAINING FRAC VALVE SEAT INSERT

(71) Applicant: AWC Frac Valves Inc., Conroe, TX (US)

(72) Inventors: Joe DeGear, Conroe, TX (US); Aaron Ladwig, Humble, TX (US); Jeremy Perkins, Cleburne, TX (US); Matthew R. Foertsch, Conroe, TX (US); Robert Ventrelli, Conroe, TX (US); Garrett Scott Laughlin, Houston, TX (US)

(73) Assignee: AWC FRAC VALVES, INC., Conroe, TX (US)

( * ) Notice: Subject to any disclaimer, the term of this patent is extended or adjusted under 35 U.S.C. 154(b) by 0 days.

(21) Appl. No.: 18/483,171

(22) Filed: Oct. 9, 2023

(51) Int. Cl.

| | |
|---|---|
| ***E21B 33/068*** | (2006.01) |
| ***F16K 3/00*** | (2006.01) |
| ***F16K 3/20*** | (2006.01) |
| ***F16K 3/36*** | (2006.01) |

(52) U.S. Cl.
CPC ..... *E21B 33/068* (2013.01)

(58) Field of Classification Search
None
See application file for complete search history.

(56) References Cited

U.S. PATENT DOCUMENTS 2,433,638 A * 12/1947 Volpin ..... F16K 3/36 251/366
3,348,567 A * 10/1967 Volpin ..... F16K 3/36 251/269
3,696,831 A * 10/1972 Fowler ..... F16K 3/36 251/327
4,051,863 A * 10/1977 Still ..... F16K 3/0227 137/454.2
4,264,054 A * 4/1981 Morrill ..... F16K 3/0236 277/644
4,519,582 A * 5/1985 Freeman ..... F16K 3/02 251/360
4,971,098 A * 11/1990 Stroud ..... F16K 3/0236 251/327
5,341,835 A * 8/1994 Lanning, II ..... F16K 3/0227 137/246.22
5,560,587 A * 10/1996 McCutcheon ..... F16K 3/0281 251/327
7,100,893 B2 * 9/2006 Williams ..... F16K 27/044 251/328

(Continued)

*Primary Examiner* — Matthew R Buck
*Assistant Examiner* — Douglas S Wood
(74) *Attorney, Agent, or Firm* — MEHRMAN LAW OFFICE; Michael J. Mehrman

(57) ABSTRACT

A grease-retaining frac valve insert to mitigate grease loss during operation of a frac valve, a frac valve assembly using one or more of the grease-retaining frac valve insert, and a wellhead including one or more frac valve assemblies using one or more of the grease-retaining frac valve inserts. The frac valve assembly includes a valve gate defining a valve aperture movable from an wellhead operating position to the valve open position. The grease-retaining frac valve insert includes a seal plate defining a cuff receptacle. A valve sealing cuff is removably received in the cuff receptacle. The valve sealing cuff carries a face sealing groove for sealing against the valve aperture as the valve gate is moved between the wellhead operating position to the valve open position.

20 Claims, 10 Drawing Sheets

(56) References Cited

U.S. PATENT DOCUMENTS

| | | | | |
|---|---|---|---|---|
| 8,056,882 | B2 * | 11/2011 | Ohlson | F16J 15/062<br>251/355 |
| 2017/0276293 | A1 * | 9/2017 | McKim | F16N 21/00 |

* cited by examiner

GREASE-RETAINING FRAC VALVE SEAT INSERT

TECHNICAL FIELD

The present invention is directed to drilling equipment and, more particularly, to a grease-retaining valve seat insert for hydraulic fracturing equipment.

BACKGROUND

A frac valve is high-pressure isolation valve that supplies the fracturing fluid to a wellhead set up for hydraulic fracturing. The frac valve is opened to supply the hydraulic fracturing fluid to the wellhead and closed to isolate the wellhead from the hydraulic fracturing fluid. Most conventional frac valves include one or more valve cavities filled with grease for lubricating the valve gate. The grease typically needs to be replenished every one or two frac stages due to excessive washing of the grease out of the valve cavity. A need exists for a more efficient frac valve that mitigates grease loss.

SUMMARY

Embodiments of the invention include a removable grease-retaining frac valve insert, a frac valve using one or more of the grease-retaining frac valve inserts, and a multi-wellhead assembly including frac valves using one or more of the grease-retaining frac valve inserts for mitigating grease loss during operation of the frac valve. The frac valve includes a flange defining a flow bore, a valve gate, and a valve cavity housing grease lubricating the valve gate as the valve gate moves between an open position and a closed positions. The grease-retaining frac valve insert includes a seal plate maintaining sliding contact with the valve gate as the valve gate moves between the open and closed positions. A cuff extending from the seal plate is interfacing with the flow bore. The seal plate covers the valve cavity over an entire length of travel of the valve aperture adjacent to the valve cavity blocking fluid in the flow bore from infiltrating the valve cavity through the valve aperture.

An optional wiper seal may be positioned in a wiper seal groove defined by the seal plate. The wiper seal, which may be fabricated from PTFE, may include beveled edges forming a central peak in sliding contact with the valve gate. As another option, a seat seal may be positioned in a seat seal groove defined by the cuff interfacing with the flow bore.

In an alternative embodiment, the cuff may be integrally formed with the seal plate, or the cuff may removable from the seal plate with a cuff gasket positioned between the cuff and the seal plate.

It will be understood that specific embodiments may include a variety of features in different combinations, as desired by different users. The specific techniques and systems for implementing particular embodiments of the invention and accomplishing the associated advantages will become apparent from the following detailed description of the embodiments and the appended drawings and claims.

BRIEF DESCRIPTION OF THE FIGURES

The numerous advantages of the embodiments of the invention may be better understood with reference to the accompanying figures.

DETAILED DESCRIPTION

Figure 1:
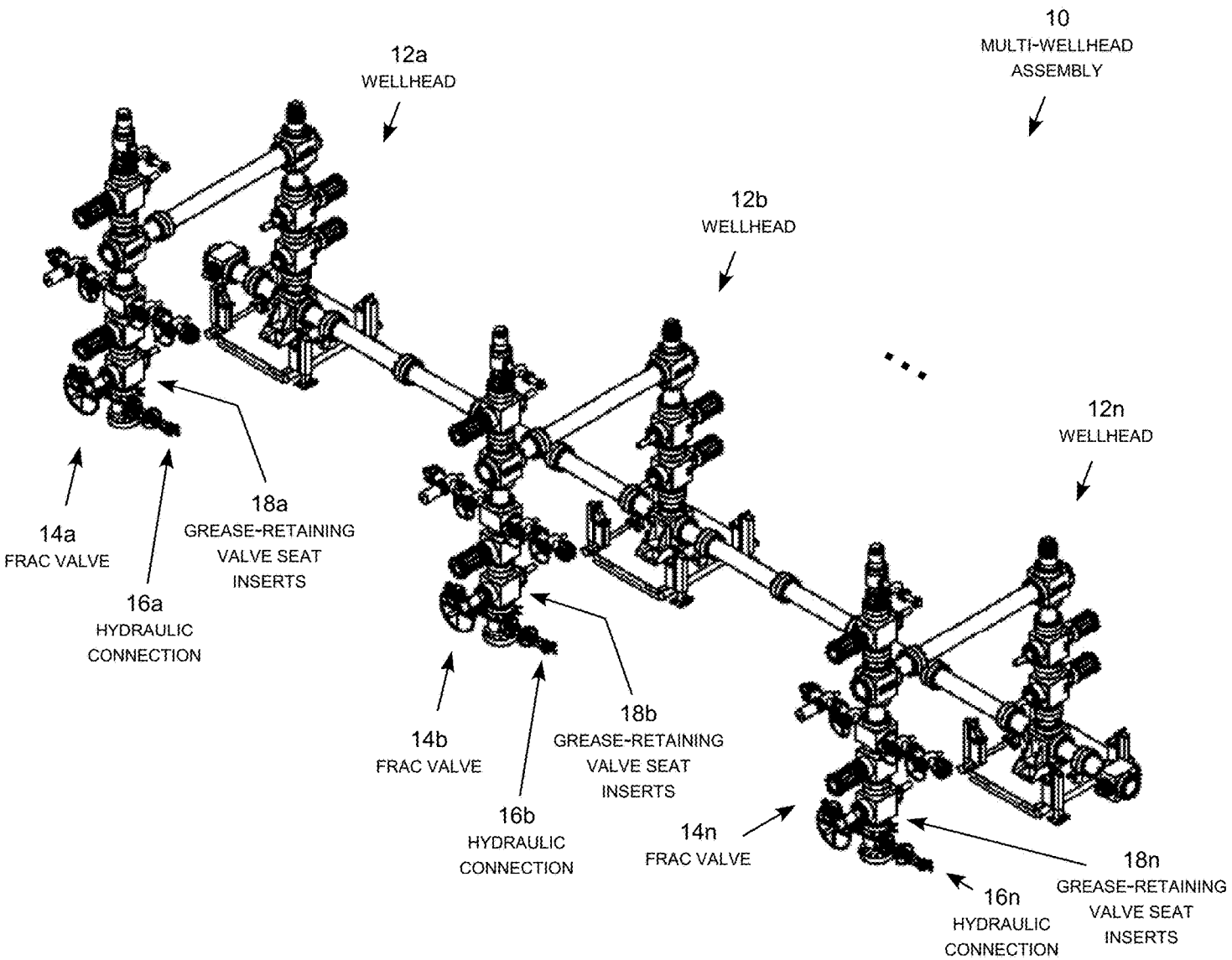
FIG. 1 is a conceptual perspective view of a multi-wellhead assembly with multiple interconnected by frac valves utilizing grease-retaining valve seat inserts.

With conventional frac valves, a large portion of the grease escapes into the flow bore every time the valve is operated. The valve gate includes a valve aperture that moves into and out of alignment with the flow bore as the valve is opened and closed. As the valve gate is moved between the open and closed positions, the valve aperture is partially aligned with the flow bore and partially aligned with the valve cavity. This creates an unimpeded infiltration path from the flow bore into the valve cavity allowing the hydraulic fracturing fluid to infiltrate the valve cavity through the valve aperture washing the grease away. To combat this, some valves utilize grease retainers positioned around the conventional valve seats. This approach is largely ineffective, however, because it does little to prevent grease loss during movement of the valve gate when the valve aperture is partially aligned with the flow bore and partially aligned with the valve cavity, which is the main source of grease loss.

The grease-retaining valve seat solves the grease-loss problem through a seal plate that covers the valve cavity over the entire length of travel of the valve aperture adjacent to the valve cavity. This prevents the hydraulic fracturing fluid from infiltrating the valve cavity through the valve aperture when the valve aperture is partially aligned with the flow bore and partially aligned with the valve cavity. The grease-retaining valve seat insert thus mitigates the grease loss during operation of the frac valve by preventing the hydraulic fracturing fluid from washing the grease out of the valve cavity during movement of the valve aperture past the valve cavity.

The grease-retaining fac valve includes a cuff designed replace the conventional valve seat in a conventional frac valve. To install the grease-retaining valve seat insert, the conventional valve seat is removed and the grease-retaining valve seat is inserted into position with the cuff in the location previously occupied by the conventional valve seat and the seal plate covering at least a portion of the grease filled valve cavity. The seal plate covers the valve cavity over the entire length of travel of the valve aperture adjacent to the valve cavity blocking fluid in the flow bore from infiltrating the valve cavity through the valve aperture. This greatly reduces the amount of grease used by the frac valve with the goal of effectively eliminating the application of grease to the frac valve in the field.

As the seal plate is the primary component preventing the grease from washing out of the valve cavity as the valve aperture moves past the valve cavity, additional features to further mitigate grease loss may be considered optional. One of these options is a wiper seal located between the seal plate and the valve gate. The wiper seal may include beveled edges forming a central peak in sliding contact with the valve gate to help prevent the wiper seal from snagging on the valve aperture. The wiper seal may also be fabricated from PTFE or another durable low-friction material. As another option, a seat seal may be located between the cuff and the flow bore.

Embodiments of the invention include a single-piece grease-retaining valve seat insert that combines the cuff and the seal plate into an integrated component. A two-piece grease-retaining valve seat insert includes a seal plate with a cuff receptacle, a removable cuff, and a cuff gasket located between the cuff and the cuff receptacle. To minimize replacement costs and increase versatility, the two-piece grease-retaining valve seat insert allows the removable cuff to be replaced without also replacing the seal plate. In a representative embodiment, the two grease-retaining fac valve seat inserts provide custom hard-faced sealing surfaces sized and shaped to replace existing valve seats in a conventional frac valve while covering the valve cavities on the upstream and downstream sides of the conventional frac valve.

Turning to the figures, specific representative embodiments of the invention are described in detail including a variety of features and options. Practicing the invention does not necessarily require utilization of all, or any particular combination, of the features or options. The specific techniques and structures for implementing particular embodiments of the invention and accomplishing the associated advantages will become apparent from the following detailed description of the embodiments and the appended drawings and claims.

FIG. 1 is a conceptual perspective view of a multi-wellhead assembly 10 with multiple wellheads 12*a*-12*n* interconnected by respective frac valves 14*a*-14*n* supplying hydraulic fracturing fluid from respective hydraulic connections 16*a*-16*n*. The number of wellheads can vary from one to many, as a typical multi-wellhead assembly begins with a first wellhead and then expands to multiple wellheads based on practical factors, such as extraction productivity, economic and regulatory factors. The frac valves 14*a*-14*n* are used to control the delivery of the hydraulic fracking fluid supplied from the hydraulic connections 16*a*-16*n* to the respective wellheads 12*a*-12*n*. This figure identifies the general locations of the grease-retaining valve seat inserts 18*a*-18*c* within the frac valves 14*a*-14*n*, which may be installed to replace the conventional valve seats in conventional frac valves to gain the advantaged of the invention without fully replacing the frac valves.

Referring to the wellhead assembly 12*a* to describe the general operation, the frac valve 14*a* is opened to place the wellhead 12*a* in an operating mode with the hydraulic fracking fluid supplied through the hydraulic connection 16*a* to the wellhead 12*a*. To take the wellhead 12*a* out of operation, the frac valve 14*a* is closed to cut off the supply of the hydraulic fracking fluid to wellhead 12*a* allowing the wellhead to be serviced for a variety of purposes while the other wellheads remain in operation. In practice, the frac valve 14*a* is operated frequently over the life of the wellhead 12*a* resulting in the need for regular maintenance. As described in more detail with reference FIGS. 2A-2C, operating of a conventional frac valve washes lubrication grease out of the frack valve resulting in excessive grease loss and frequently grease replenishment. The grease-retaining valve seat insert 18*a* solves this problem by mitigating the loss of grease from the frac valve 14*a* with the goal of eliminating the need to replenish the grease in the field.

Figure 2B:
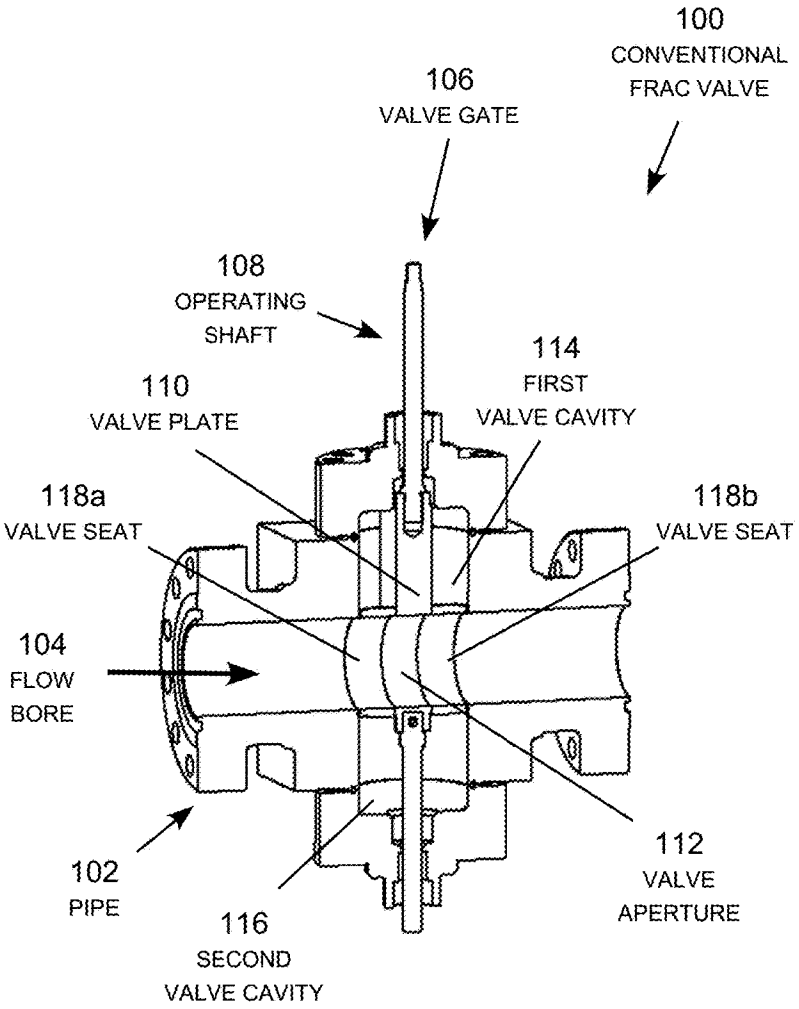
FIG. 2B (PRIOR ART)
FIGS. 2A-2C (prior art) are cross-sectional views of a conventional frac valve.
Figure 2A:
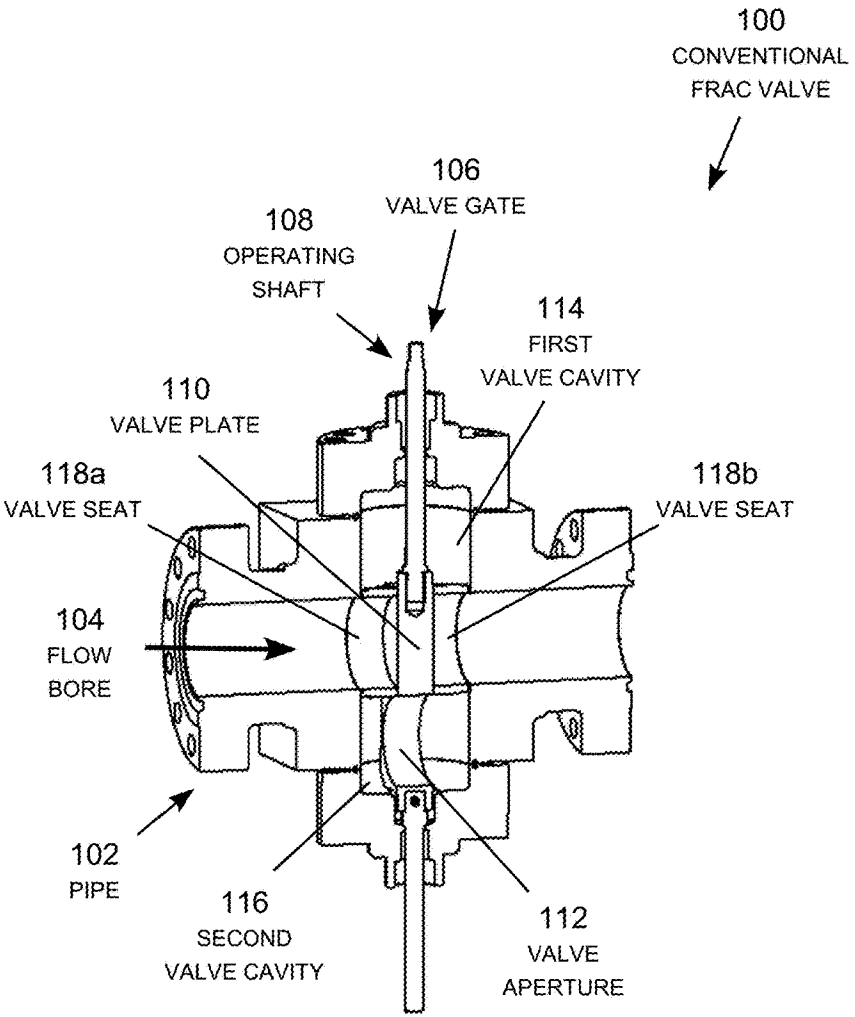
FIG. 2A (PRIOR ART)
Figure 2C:
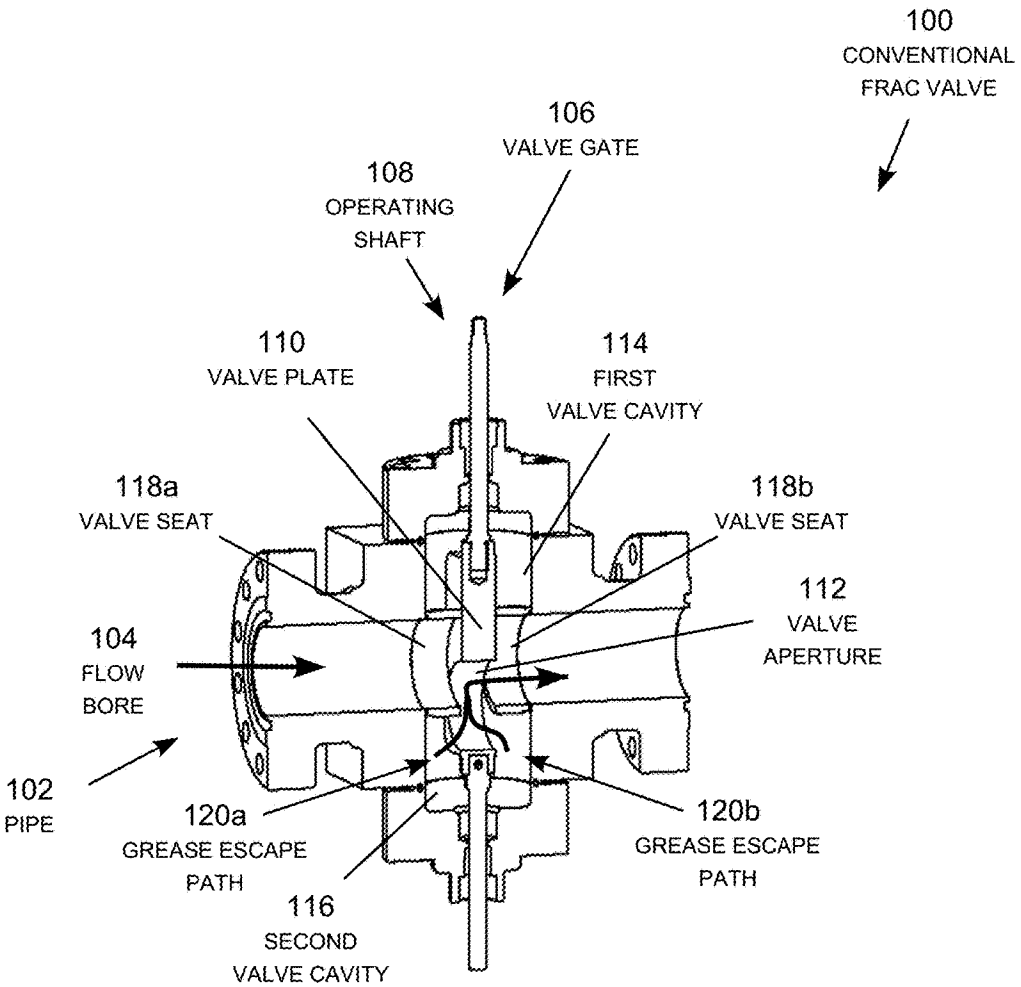
FIG. 2C (PRIOR ART)

FIGS. 2A-2C (prior art) are cross-sectional views of a conventional frac valve 100, which includes a flange 102 defining a flow bore 104 for conveying the hydraulic fracturing fluid through the valve. To control the flow of the hydraulic fracturing fluid, the conventional frac valve 100 includes a valve gate 106 controlled by operation of the operating stem 108, typically by manual or motorized rotation of the operating stem. The valve gate 106 includes a valve plate 110 and a valve aperture 112 that can be selectively positioned in alignment with the flow bore 104 by lowering and raising the valve gate 106 to close and open the conventional frac valve 100.

Lowering the valve gate 106 moves the valve plate 110 from a first valve cavity 114 into alignment with the flow bore 104, while simultaneously moving the valve aperture 112 from alignment with the flow bore into a second valve cavity 116 to close the frac valve 100. Similarly, raising the valve gate 106 moves the valve plate 110 from alignment with the flow bore 104 into the first valve cavity 114, while simultaneously moving the valve aperture 112 from the second valve cavity 116 into alignment with the flow bore to open the frac valve 100. The first and second valve cavities 114, 116 are filled with grease to lubricate the valve gate 106 while it moves between the open and closed positions. As the valve gate 106 moves between the open and closed positions, the valve aperture 112 moves past conventional valve seats 118*a* and 118*b* positioned around the flow bore 104 on opposing sides of the valve gate 106.

FIG. 2A shows the conventional frac valve 100 in the closed position, in which the valve plate 110 is aligned with the flow bore 104 blocking the flow of the hydraulic fracturing fluid through the valve. FIG. 2B shows the conventional frac valve 100 in the fully open position, in which the valve aperture 112 is fully aligned with the flow bore 104 permitting the flow of the hydraulic fracturing fluid through the valve. FIG. 2C shows the conventional frac valve 100 in a partially open position, in which the valve aperture 112 is partially aligned with the flow bore 104, while also partially aligned with the second valve cavity 116. When the valve aperture 112 is partially aligned with the flow bore 104 and partially aligned with the second cavity 116, the conventional valve seats 118*a* and 118*b* allow the pressurized hydraulic fracturing fluid in the flow bore 104 to freely infiltrate the second valve cavity 116. This is indicated by the grease escape paths 120*a* and 120*b* shown in FIG. 2C when the valve aperture 112 is in the partially open position. During the opening and closing strokes of the valve gate 106, communication of the hydraulic fracturing fluid into second valve cavity 116 is substantially uninhibited as the valve aperture 112 moves into and out of alignment with the second valve cavity 116 resulting in excessive grease loss requiring frequent grease replenishment. In other words, the grease escape paths 120*a* and 120*b* are created during valve operation as the valve aperture 112 moves past and adjacent to the second valve cavity 116, while the valve aperture is partially aligned with the flow bore 104 and partially aligned with the second valve cavity. As a result, the grease in the conventional frac valve 100 typically has to be replenished at every one or two frac stages of the hydraulic fracturing operation.

Figure 3B:
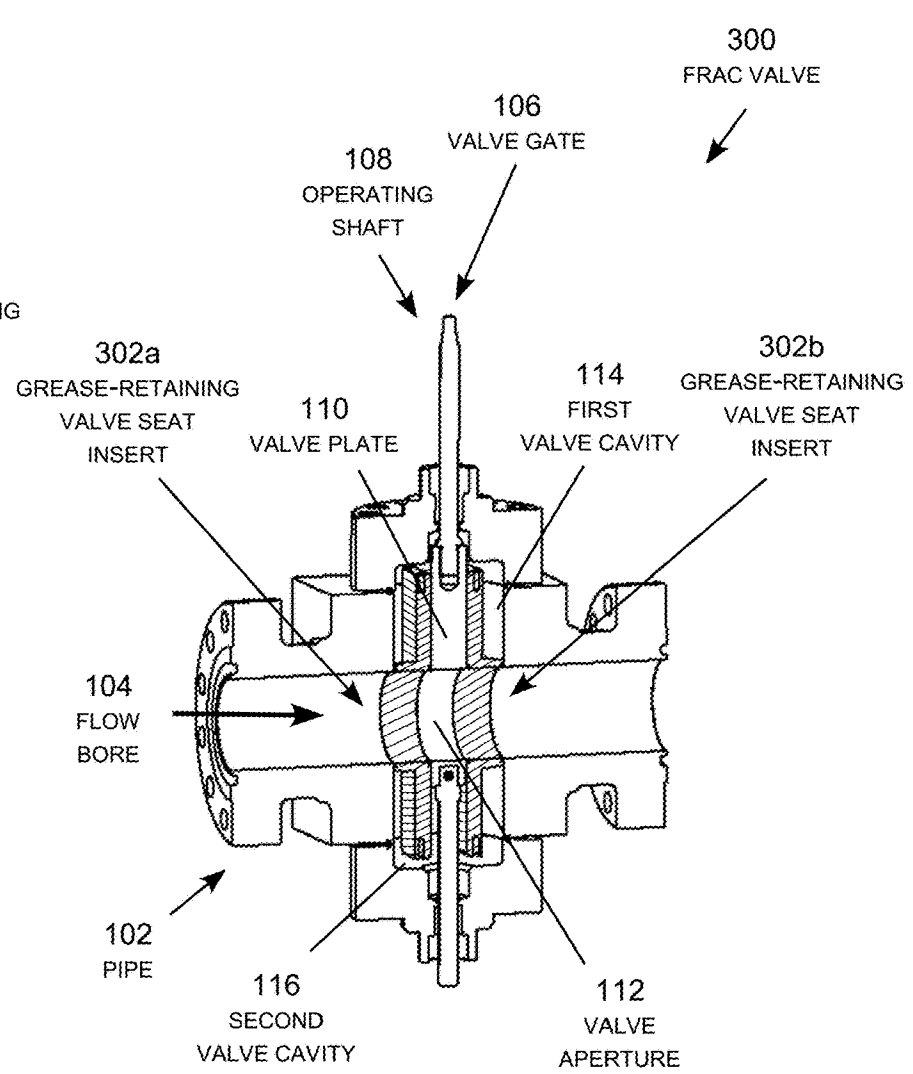
FIGS. 3A-3C are cross-sectional views of a frac valve with grease-retaining frac valve seat inserts illustrating a representative embodiment of the invention.
Figure 3A:
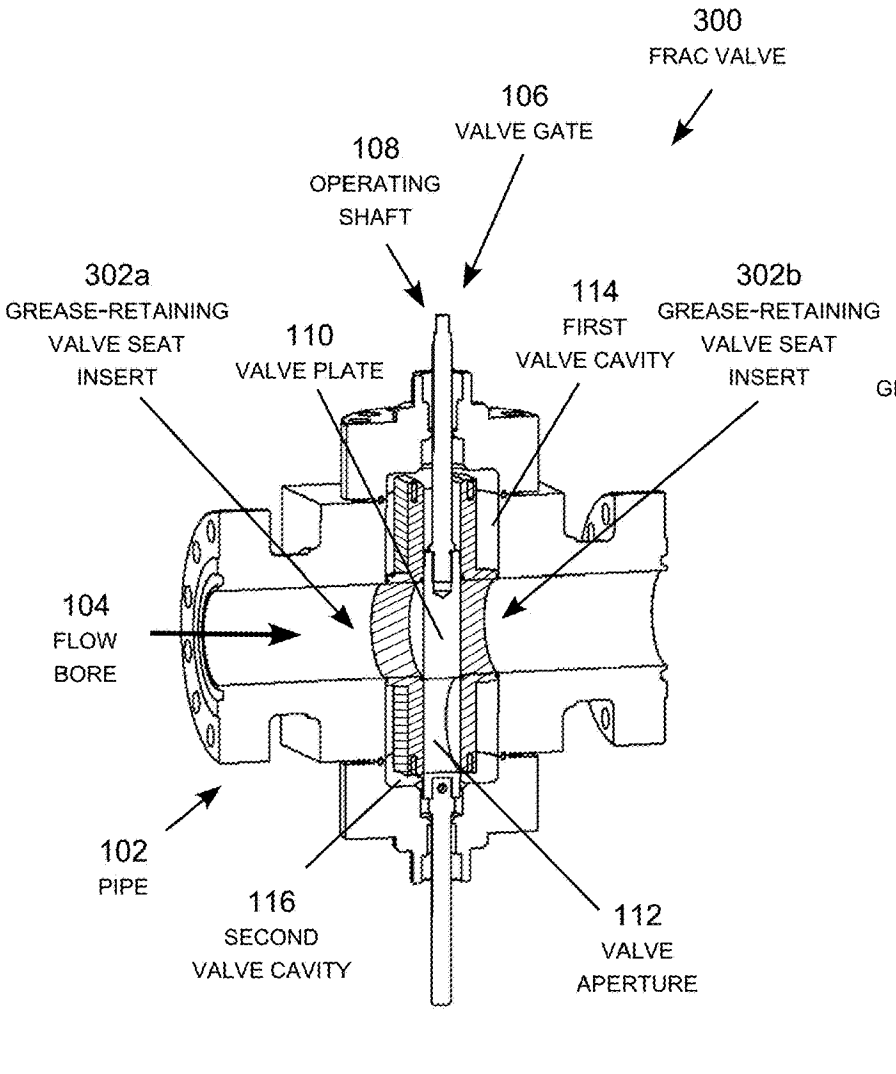

FIGS. 3A-3B are cross-sectional views of an improved frac valve 300 with grease-retaining frac valve seat inserts 302*a* and 302*b* highlighted by cross-hatching. The grease-retaining frac valve seat inserts 302*a* and 302*b* span the across and seal the first and second valve cavities 114 and 116 to prevent the pressurized hydraulic fracturing fluid in the flow bore 104 from infiltrating the valve cavities. The grease-retaining frac valve seat inserts 302*a* and 302*b* remain stationary and in sliding contact with the valve gate 106 as the valve gate moves between the open and closed positions. Covering the second valve cavity 116 over the entire length of movement of the valve aperture 112 adjacent to the second valve cavity mitigates the excessive grease loss from the conventional frac valve 100 illustrated in FIG. 2C. The grease-retaining frac valve seat inserts 302*a* and 302*b* also improve the seals with first valve cavity 114 and the flow bore 104, further mitigating grease loss with the goal of substantially eliminating the need for grease replenishment in the field.

Cuffs of the grease-retaining frac valve seat inserts 302*a* and 302*b* line the flange 102 around the flow bore 104 on opposing sides of the valve gate 106 in the regions occupied by the conventional valve seats 118*a* and 118*b* in the conventional frac valve 100. As a result, the improved frac valve 300 can be fabricated, for example, by retrofitting the conventional frac valve 100 by replacing the conventional valve seats 118*a* and 118*b* with the grease-retaining frac valve seat inserts 302*a* and 302*b*. As another option, the grease-retaining frac valve seat inserts 302*a* and 302*b* can be provided as original equipment in new or rebuilt frac valves.

Figure 3C:
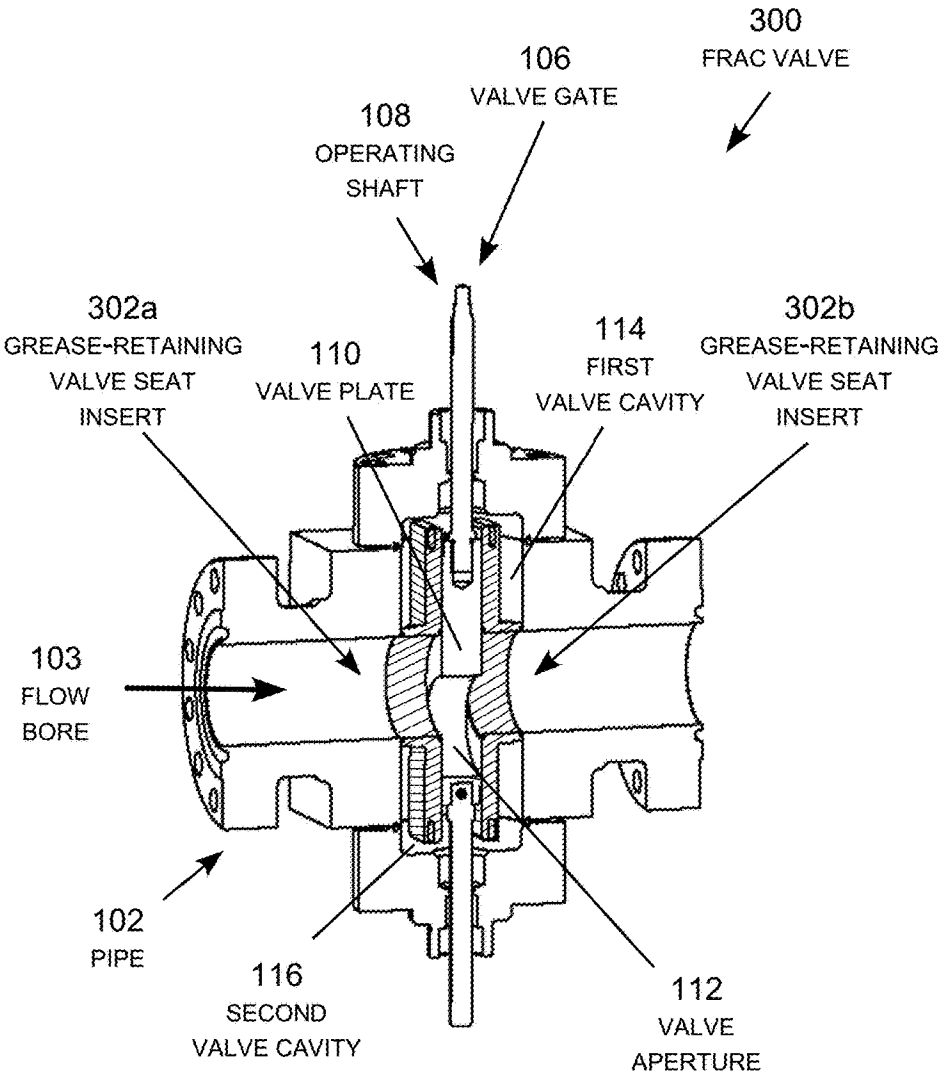
Figures 4A, 4B, 4C:
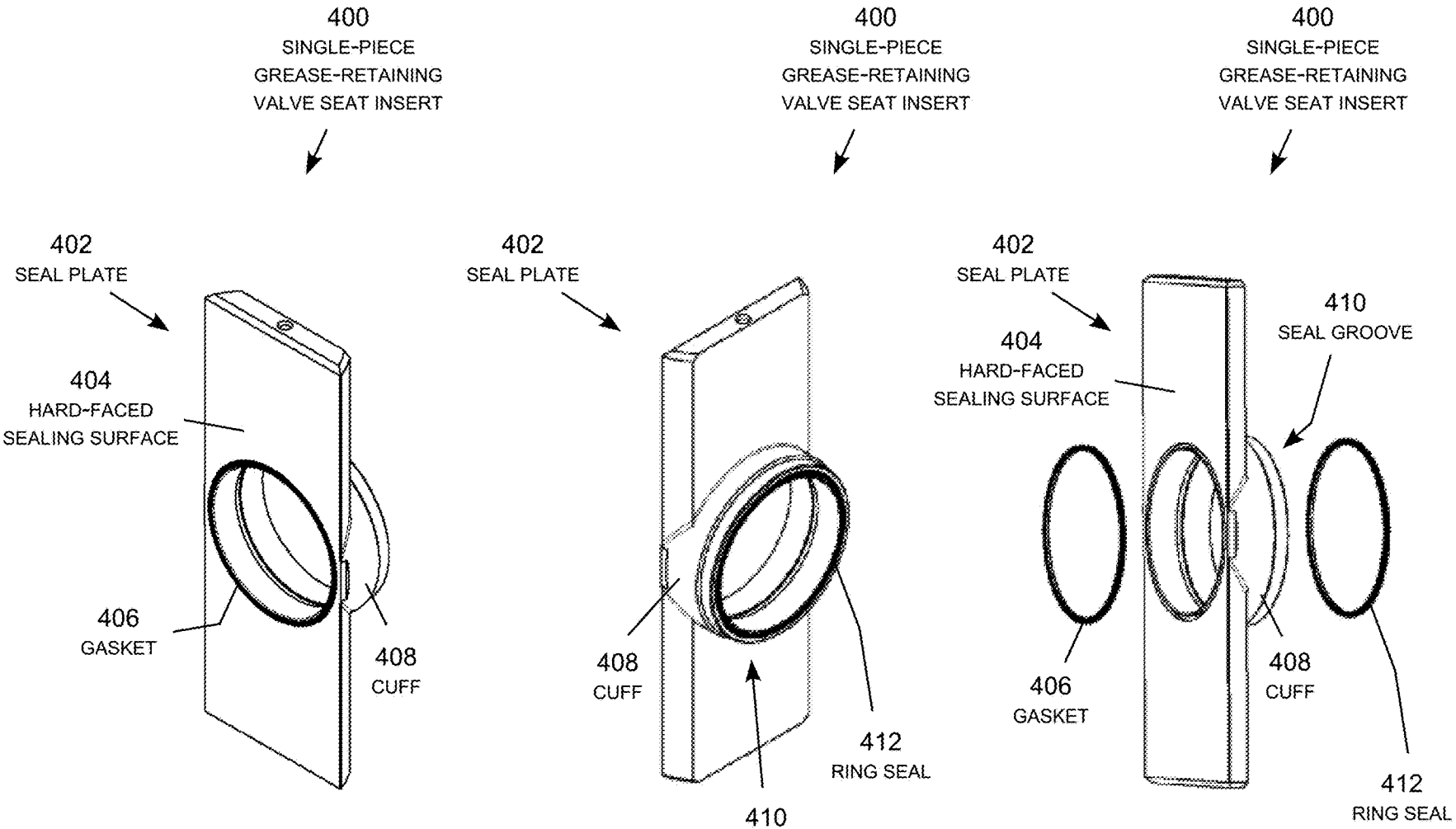
FIGS. 4A and 4B are perspective views of a single-piece grease-retaining frac valve seat insert.
FIG. 4C is a perspective exploded view of the single-piece grease-retaining frac valve seat insert.
Figure 5B:
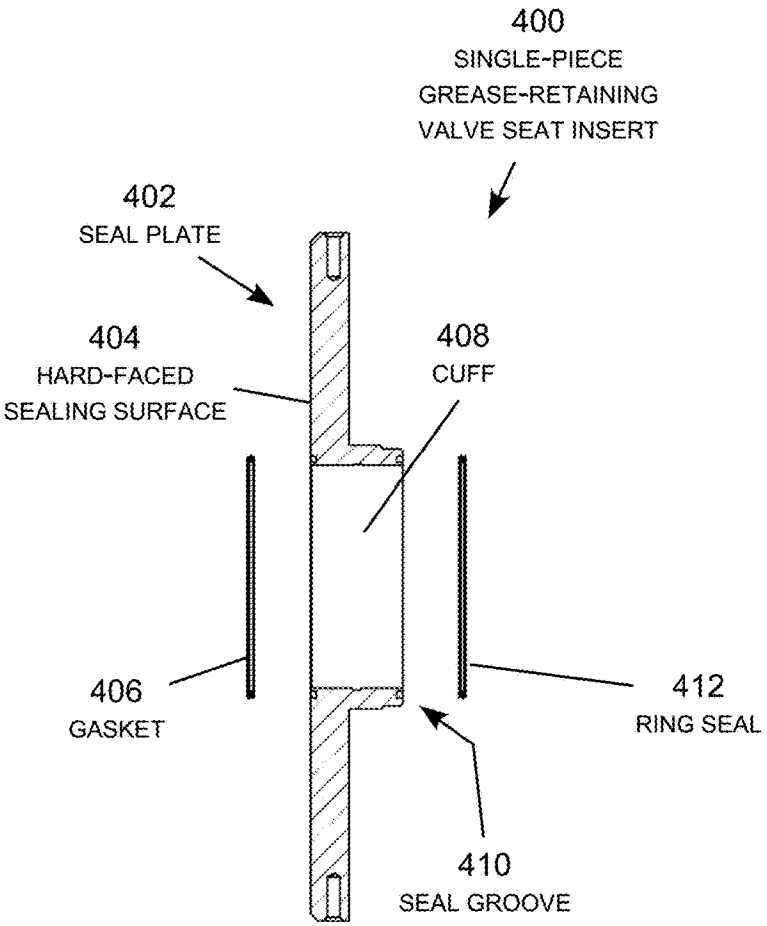
FIG. 5B is an exploded side view of the single-piece grease-retaining frac valve seat insert.
Figure 5A:
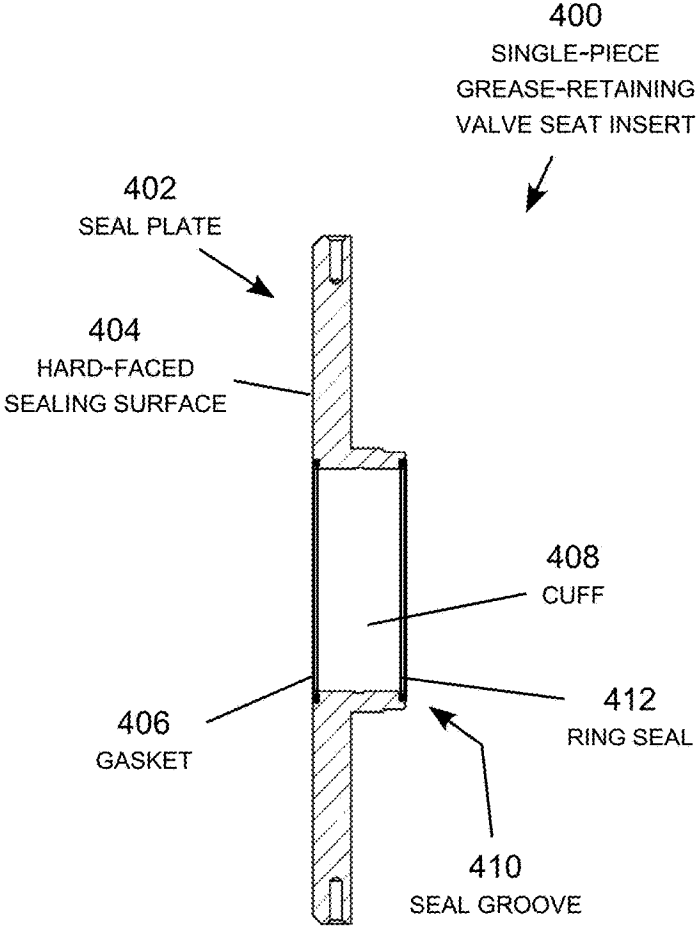
FIG. 5A is a side view of the single-piece grease-retaining frac valve seat insert.

To illustrate a representative embodiment, FIGS. 4A and 4B show perspective views, while FIG. 4C shows an exploded perspective view, of a single-piece grease-retaining frac valve seat insert 400. In addition, FIG. 5A shows a side view and FIG. 5B shows an exploded side of the single-piece grease-retaining frac valve seat insert 400. This particular grease-retaining frac valve seat insert 400 may be specifically designed to be received in the corresponding frac valve 300 shown in FIGS. 3A-3C. In this example, the grease-retaining frac valve seat insert 400 includes a seal plate 402 specifically sized and shaped to span across and seal the first and second valve cavities 114 and 116 of the corresponding frac valve 300. The wiper seal 406 and the seat seal 412 described below are indicated on FIG. 3C to orient the grease-retaining valve seat insert 302*a* within the frac valve 300.

The seal plate 402 includes a durable hard-faced sealing surface 404, a wiper seal groove 405, and a wiper seal 406 positioned in the wiper seal groove. The seal plate 402 also includes a cuff 408, a seat seal groove 410, and a seat seal 412 received in the seat seal groove. The cuff 408 is sized and shaped to replace a conventional valve seat removed from the corresponding frac valve 300. In this embodiment, the cuff 408 is integrally formed with the seal plate 402 in the single-piece configuration. As indicated on FIG. 3C, the wiper seal 406 is positioned adjacent to the valve gate 106, while the seat seal 412 is positioned adjacent to the flow bore 104. The wiper seal 406 maintains a tight seal against the valve gate 106 without snagging on the valve aperture 112 as the valve aperture moves past the wiper seal into and out of alignment with the second valve cavity 116. The seat seal 412 maintains a tight seal against the flow bore 104 to prevent fluid from infiltrating at this location.

Figure 6A:
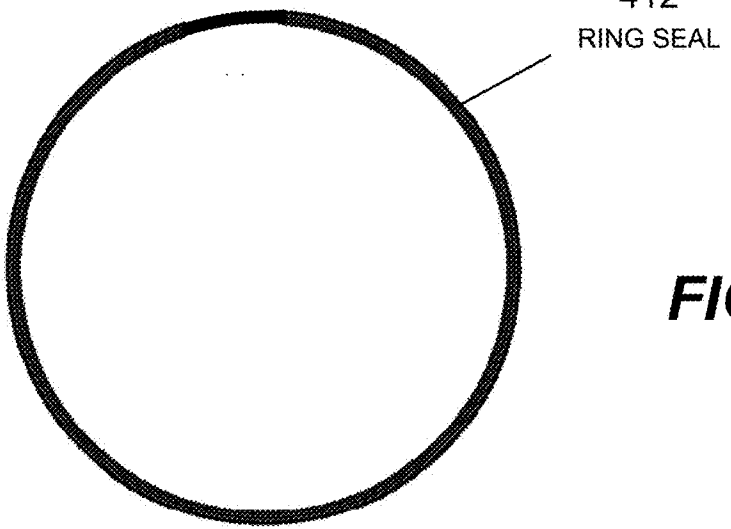
FIG. 6A is a side view of the grease-retaining frac valve seat insert.
Figure 6B:
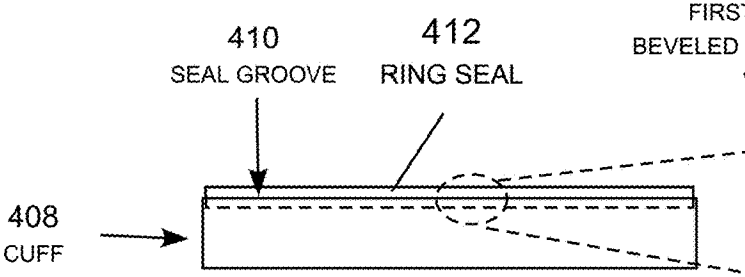
FIG. 6B is a cross-sectional view of a wiper seal.
Figure 6C:
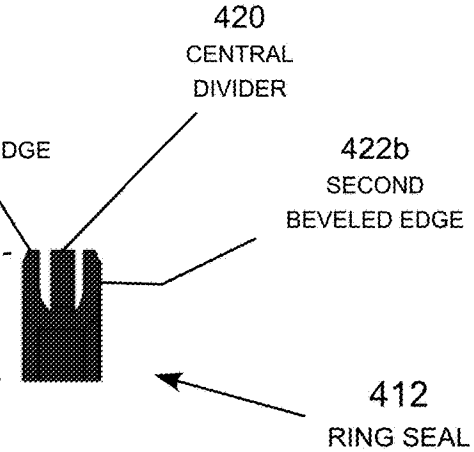
FIG. 6C is cross-sectional view of an enlarged portion of FIG. 6B.

To further illustrate the representative embodiment, FIG. 6A is a side view of the grease-retaining frac valve seat insert 400, FIG. 6B is a cross-section view of the wiper seal 406, and FIG. 6C is cross-sectional view of an enlarged portion of FIG. 6B. The wiper seal 406 may include beveled edges forming a central peak 420 for interfacing with the moving valve gate 106. This configuration allows the wiper seal to flex while maintaining a seal with the valve gate 106, while also maintaining sliding contact with the valve gate 106 without snagging on the valve aperture 112 as the valve aperture moves past the wiper seal in both directions during opening and closing of the valve gate.

Figures 7A, 7B, 7C:
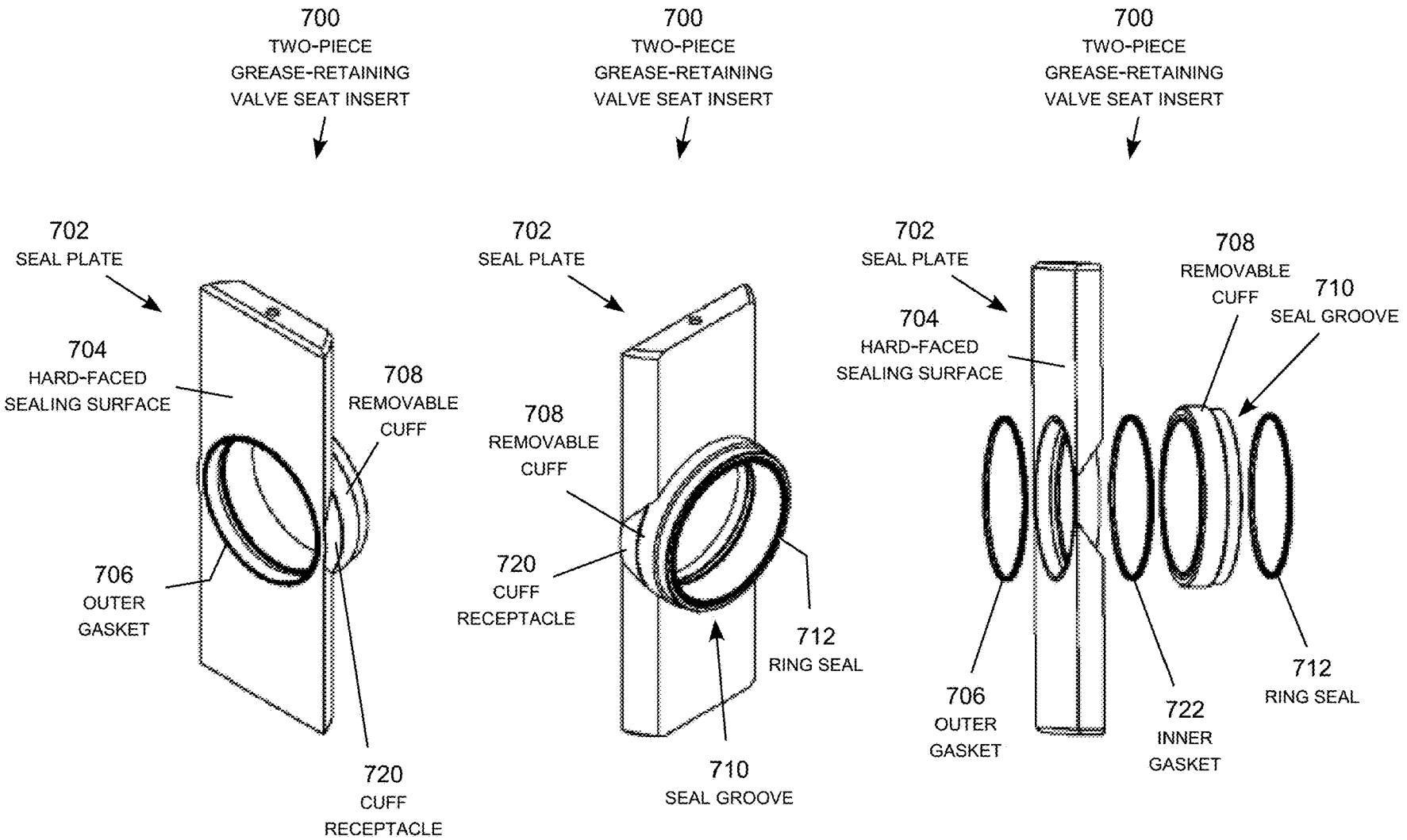
FIGS. 7A and 7B are perspective views of a two-piece grease-retaining frac valve seat insert.
FIG. 7C is a perspective exploded view of the two-piece grease-retaining frac valve seat insert.
Figure 8B:
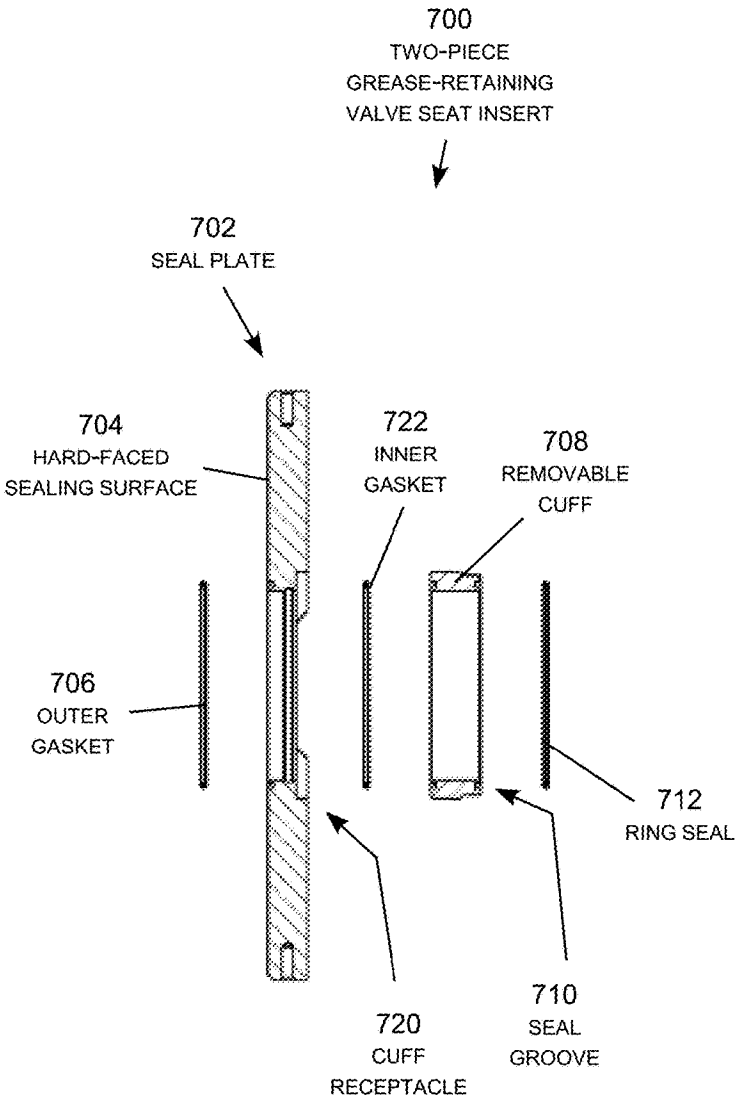
FIG. 8B is a perspective exploded view of the two-piece grease-retaining frac valve seat insert.
Figure 8A:
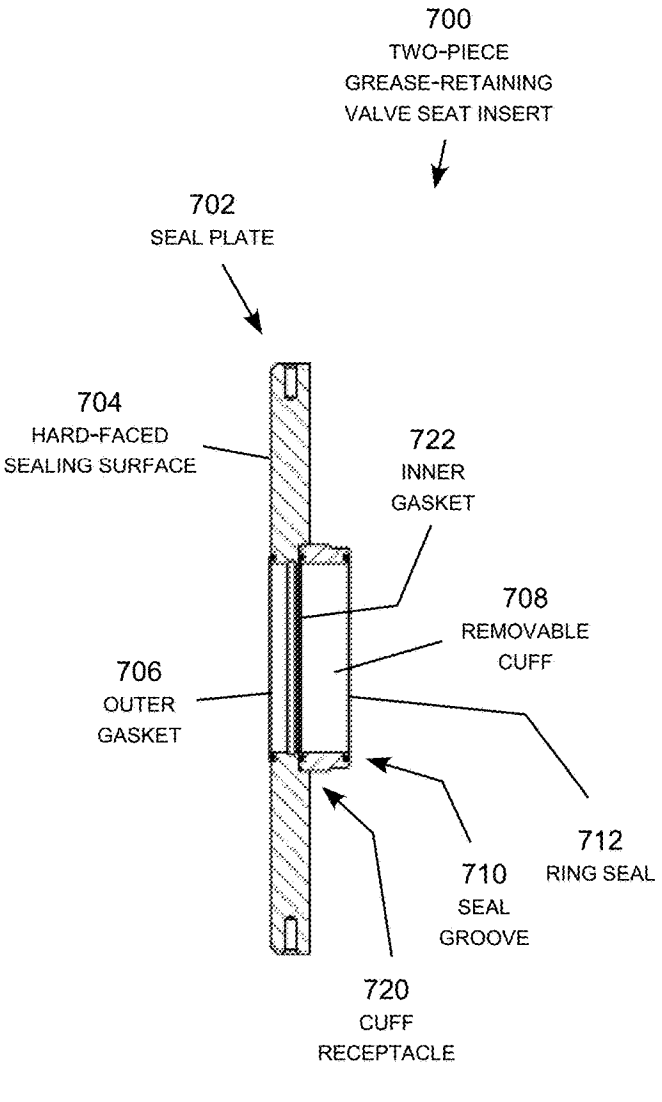
FIG. 8A is a side view of the two-piece grease-retaining frac valve seat insert.

FIGS. 7A and 7B describe an alternative embodiment with a removable cuff that facilitates replacement of a permanently attached wiper seal without replacing the entire grease-retaining valve seat insert. FIGS. 7A and 7B show perspective views, while FIG. 7C shows an exploded perspective view of a two-piece grease-retaining frac valve seat insert 700. In addition, FIG. 8A shows a side view and FIG. 8B shows an exploded side of the two-piece grease-retaining frac valve seat insert 700. The two-piece grease-retaining frac valve seat insert 700 is similar to the single-piece frac valve seat insert 400 except the integral cuff 408 is replaced by a removable cuff 708. More specifically, the grease-retaining frac valve seat insert 700 includes a seal plate 702 specifically sized and shaped to span across and seal the first and second valve cavities 114 and 116 of the corresponding frac valve 300. The seal plate 702 includes a durable hard-faced sealing surface 704 and removable cuff 708 selectively received in a cuff receptacle 720 defined by the seal plate 702. The seal plate 702 also includes a wiper seal groove 705 and a wiper seal 706 positioned in the wiper seal groove. The removable cuff 708 includes a seat seal groove 710 and a seat seal 712 received in the seat seal groove.

As with the valve seat insert 400, the removable cuff 708 may be sized and shaped to snugly interface with the corresponding frac valve 300 when installed in the cuff receptacle 720. The wiper seal 706 provides a seal at the sliding interface between the seal plate 702 and the valve gate 106 without snagging on the valve aperture 112 as the valve aperture moves past the wiper seal into and out of the second valve cavity 116 mitigating the extreme grease loss occurring in the conventional frac valve 100 illustrated in FIG. 2C.

In this embodiment, the removable cuff 708 is selectively received in the cuff receptacle 720 defined by the seal plate 702, for example by screwing, press-fitting, or twist locking into the cuff receptacle allowing the removable cuff 708 to be removed and replaced without removing and replacing the seal plate 702. This allows different cuffs to be attached to the same seal plate improving the versatility of the grease-retaining valve seat insert.

It will be appreciated that the improved frac valves can be positioned in any desired orientation, and may include one or more flanges, valve gates, grease-filled valve cavities, and grease-retaining valve seat inserts. It will be also appreciated that seal plate may be somewhat smaller than the representative embodiments provided the seal plate covers the entire length of travel of the valve aperture adjacent to the valve cavity to prevent the hydraulic fracturing fluid from infiltrating the valve cavity through the valve aperture. The seal plate may therefore fully or partially cover the valve cavity provided that it covers the entire length of travel of the valve aperture adjacent to the valve cavity. For example, a portion of the valve cavity may remain uncovered to supply grease to the valve gate at a location not exposed to the valve aperture during operation of the valve.

The grease-retaining valve seat inserts are not limited to any particular type or location of valve in wellhead system. The representative embodiments may include seal plates and cuffs fabricated from steel with gaskets and wiper seal fabricated from polytetrafluoroethylene (PTFE), which are suitable low cost, durable, easily formed materials. However, other materials may be used as a matter of design choice. For example, alternative embodiments of the seal plates and cuffs may be fabricated from a variety of other rigid, water-impervious materials suitable this type of high-pressure application, such polycarbonate, fiberglass, glass-filled nylon, acrylonitrile butadiene styrene (ABS), high-density polyethylene (HDPE), ceramics, and blends thereof. Alternative seal plates and cuffs may also be fabricated from low-cost polymeric materials lined with steel, ceramic or other more durable materials. Similarly, the gaskets and wiper seals may be fabricated from a variety of other flexible, water-impervious materials suitable this type of application, such as rubber, silicon, flexible polyvinyl chloride (PVC), polychloroprene (neoprene), ethyl carbamate (urethane), polyurethane, flexible polyvinyl chloride (PVC), and blends thereof.

In embodiments utilizing single-piece seal grease-retaining valve seat inserts, removable wiper seals and seat seals may be considered sacrificial components, while the seal plates may be utilized to receive multiple wiper seals over the lives of the seal plates. Similarly, in embodiments utilizing two-piece seal grease-retaining valve seat inserts, removable cuffs may also be considered sacrificial components, while the seal plates may be utilized to receive removable cuffs over the lives of the seal plates. Alternative seal rings may also be utilized, such as multiple concentric seal rings, seal rings with additional edge layers, seal rings fabricated from multiple materials, and so forth.

In general, the drawings are in simplified form designed to concisely conceptualize the invention and are not to precise scale unless specifically indicated. The same or similar reference numerals may be used to refer to the same or similar parts. The words "couple," "connect," "adjacent" and the like do not necessarily denote direct contact, but generally refer to operative connection which may generally be accomplished through intermediate components. Certain descriptors, such "first" and "second," "top and bottom," "upper" and "lower," "inner" and "outer," "leading" and "trailing," "vertical" and "horizontal" or similar relative terms may be employed to differentiate similar structures from each other. These descriptors are generally utilized as a matter of descriptive convenience and are not employed to implicitly limit the invention to any particular position or orientation unless specifically claimed.

Though the representative embodiments of the invention described above, those skilled in the art will be enabled to make various modifications without departing from the spirit and scope of the invention as defined by the following claims.

The invention claimed is:

1. A removable grease-retaining frac valve insert for mitigating grease loss during operation of a frac valve, the frac valve comprises a flange defining a flow bore, a valve gate comprising a valve aperture, and a valve cavity housing grease lubricating the valve gate as the valve gate moves between an open position and a closed position, the grease-retaining frac valve insert comprising:

a seal plate maintaining sliding contact with the valve gate as the valve gate moves between the open and closed positions;

a cuff extending from the seal plate interfacing with the flow bore;

wherein the seal plate covers the valve cavity over an entire length of travel of the valve aperture adjacent to the valve cavity blocking fluid in the flow bore from infiltrating the valve cavity through the valve aperture;

wherein the seal plate and cuff are configured for removable installation in the frac valve with the cuff in a location previously occupied by a removed conventional valve seat and the seal plate covering at least a portion of the grease filled valve cavity.

2. The grease-retaining frac valve insert of claim 1, further comprising:

a wiper seal groove defined by the seal plate;

a wiper seal positioned in the wiper seal groove interfacing with the valve gate.

3. The grease-retaining frac valve insert of claim 2, wherein the wiper seal further comprises beveled edges forming a central peak in sliding contact with the valve gate.

4. The grease-retaining frac valve insert of claim 3, wherein the wiper seal is fabricated from PTFE.

5. The grease-retaining frac valve insert of claim 1, further comprising:

a seat seal groove defined by the cuff;

a seat seal positioned in the seat seal groove interfacing with the flow bore.

6. The grease-retaining frac valve insert of claim 1, wherein the cuff is integrally formed with the seal plate.

7. The grease-retaining frac valve insert of claim 1, wherein the cuff is removable from the seal plate further comprising a cuff gasket positioned between the cuff and the seal plate.

8. A frac valve assembly comprising:

a flange defining a flow bore;

a valve gate;

a valve cavity housing grease lubricating the valve gate as the valve gate moves between an open position and a closed position;

a removable grease-retaining frac valve insert comprising a seal plate maintaining sliding contact with the valve gate as the valve gate moves between the open and closed positions, and a cuff extending from the seal plate interfacing with the flow bore;

wherein the seal plate covers the valve cavity over an entire length of travel of the valve aperture adjacent to the valve cavity blocking fluid in the flow bore from infiltrating the valve cavity through the valve aperture;

wherein the seal plate and cuff are configured for removable installation in the frac valve with the cuff in a location previously occupied by a removed conventional valve seat and the seal plate covering at least a portion of the grease filled valve cavity.

9. The frac valve assembly of claim 8, further comprising:

a wiper seal groove defined by the seal plate;

a wiper seal positioned in the wiper seal groove interfacing with the valve gate.

10. The frac valve assembly of claim 9, wherein the wiper seal further comprises beveled edges forming a central peak in sliding contact with the valve gate.

11. The frac valve assembly of claim 10, wherein the wiper seal is fabricated from PTFE.

12. The frac valve assembly of claim 8, further comprising:

a seat seal groove defined by the cuff;

a seat seal positioned in the seat seal groove interfacing with the flow bore.

13. The frac valve assembly of claim 8, wherein the cuff is integrally formed with the seal plate.

14. The frac valve assembly of claim 8, wherein the cuff is removable from the seal plate further comprising a cuff gasket positioned between the cuff and the seal plate.

15. A multi-wellhead assembly comprising a plurality of hydraulically connected wellheads, wherein each wellhead includes a frac valve comprising:

a flange defining a flow bore;

a valve gate;

a valve cavity housing grease lubricating the valve gate as the valve gate moves between an open position and a closed position;

a removable grease-retaining frac valve insert comprising a seal plate maintaining sliding contact with the valve gate as the valve gate moves between the open and closed positions, and a cuff extending from the seal plate interfacing with the flow bore;

wherein the seal plate covers the valve cavity over an entire length of travel of the valve aperture adjacent to the valve cavity blocking fluid in the flow bore from infiltrating the valve cavity through the valve aperture;

wherein the seal plate and cuff are configured for removable installation in the frac valve with the cuff in a location previously occupied by a removed conventional valve seat and the seal plate covering at least a portion of the grease filled valve cavity.

16. The multi-wellhead assembly of claim 15, wherein each wiper seal grease-retaining frac valve insert further comprises a wiper seal groove defined by the seal plate, and a wiper seal positioned in the wiper seal groove interfacing with the valve gate.

17. The multi-wellhead assembly of claim 16, wherein each wiper seal further comprises beveled edges forming a central peak in sliding contact with the valve gate.

18. The multi-wellhead assembly of claim 15, wherein each grease-retaining frac valve insert further comprises a seat seal groove defined by the cuff, and a seat seal positioned in the seat seal groove interfacing with the flow bore.

19. The multi-wellhead assembly of claim 15, wherein each cuff is integrally formed with the seal plate.

20. The multi-wellhead assembly of claim 15, wherein each cuff is removable from the seal plate further comprising a cuff gasket positioned between the cuff and the seal plate.

* * * * *